US006998785B1

(12) United States Patent
Silfvast et al.

(10) Patent No.: US 6,998,785 B1
(45) Date of Patent: Feb. 14, 2006

(54) LIQUID-JET/LIQUID DROPLET INITIATED PLASMA DISCHARGE FOR GENERATING USEFUL PLASMA RADIATION

(75) Inventors: William T. Silfvast, St. Helena, CA (US); Martin C. Richardson, Geneva, FL (US)

(73) Assignee: University of Central Florida Research Foundation, Inc., Orlando, FL (US)

( * ) Notice: Subject to any disclaimer, the term of this patent is extended or adjusted under 35 U.S.C. 154(b) by 305 days.

(21) Appl. No.: 10/194,387

(22) Filed: Jul. 12, 2002

Related U.S. Application Data

(60) Provisional application No. 60/305,334, filed on Jul. 13, 2001.

(51) Int. Cl.
*H01J 7/24* (2006.01)
*H05B 31/26* (2006.01)

(52) U.S. Cl. ..... 315/111.71; 315/111.01; 250/504 R; 378/119; 313/231.31; 313/231.61; 118/723 MP

(58) Field of Classification Search ..... 378/34, 378/119, 122, 143; 250/504 R, 493.1; 313/231.31, 313/231.61, 231.01, 231.41, 231.51; 315/111.21, 315/111.71, 111.01, 111.41, 111.81; 118/723 MP
See application file for complete search history.

(56) References Cited

U.S. PATENT DOCUMENTS

| | | | | |
|---|---|---|---|---|
| 4,229,708 | A | 10/1980 | Mani | 331/94.5 |
| 4,441,189 | A | 4/1984 | Macklin | 372/76 |
| 4,538,291 | A | 8/1985 | Iwamatsu | 378/119 |
| 4,574,198 | A | 3/1986 | Lucas | 250/493.1 |
| 4,592,056 | A | 5/1986 | Elton | 372/5 |
| 4,860,328 | A | 8/1989 | Frankel | 378/34 |
| 4,872,189 | A | 10/1989 | Frankel | 378/119 |
| 4,937,832 | A | 6/1990 | Rocca | 372/5 |
| 4,994,715 | A * | 2/1991 | Asmus et al. | 315/111.71 |
| 5,177,774 | A | 1/1993 | Suckewer | 378/43 |
| 5,563,923 | A | 10/1996 | Okada | 378/138 |
| 5,577,092 | A | 11/1996 | Kublak | 378/119 |
| 5,585,641 | A | 12/1996 | Sze | 250/492.1 |
| 5,606,588 | A | 2/1997 | Umstadter | 378/119 |
| 5,963,616 | A | 10/1999 | Silfvast | 378/122 |
| 6,232,613 | B1 | 5/2001 | Silfvast | 250/504 |
| 6,307,913 | B1 * | 10/2001 | Foster et al. | 378/34 |
| 6,324,256 | B1 * | 11/2001 | McGregor et al. | 378/119 |
| 6,356,618 | B1 * | 3/2002 | Fornaciari et al. | 378/119 |
| 6,665,326 | B1 * | 12/2003 | Kusunose | 372/57 |

* cited by examiner

*Primary Examiner*—Edward J. Glick
*Assistant Examiner*—Elizabeth Keaney
(74) *Attorney, Agent, or Firm*—Brian S. Steinberger; Law Offices of Brian S. Steinberger, P.A.

(57) ABSTRACT

Plasma discharge sources for generating emissions in the VUV, EUV and X-ray spectral regions. Embodiments can include running a current through liquid jet streams within space to initiate plasma discharges. Additional embodiments can include liquid droplets within the space to initiate plasma discharges. One embodiment can form a substantially cylindrical plasma sheath. Another embodiment can form a substantially conical plasma sheath. Another embodiment can form bright spherical light emission from a cross-over of linear expanding plasmas. All the embodiments can generate light emitting plasmas within a space by applying voltage to electrodes adjacent to the space. All the radiative emissions are characteristic of the materials comprising the liquid jet streams or liquid droplets.

20 Claims, 8 Drawing Sheets

LIQUID-JET/LIQUID DROPLET INITIATED PLASMA DISCHARGE FOR GENERATING USEFUL PLASMA RADIATION

This invention relates to discharge sources, and in particular to methods and apparatus for using liquid jet streams or liquid droplets within spaces to form plasma discharge for generating debris free and debris reduced emissions in the VUV, EUV, and X-ray spectral regions, and this invention claims the benefit of priority to U.S. Provisional Application Ser. No. 60/305,334 filed Jul. 13, 2001, by the same inventors and assignee as the subject invention.

BACKGROUND AND PRIOR ART

Various types of plasma discharge radiation sources have been proposed over the years. For example, capillary plasma discharge sources generate emissions in various wavelengths, that have include the EUV spectral ranges. The capillary discharge sources generally require a discharge occurring as a consequence of inducing electrical current into a gas located in a bore within a cavity. However, problems have occurred with these capillary discharge sources that have included but not limited to debris that also is emitted by the capillary discharge sources. The debris has the result of reducing the operating lifespan of these sources since the debris has been known to damage the surrounding optics such as lens, and other optical components that are used with the capillary discharge sources. In addition the interior walls of the capillary plasma discharge sources constantly wear down during operation which results in a limited lifespan for the sources. Various types of capillary discharge sources have included U.S. Pat. Nos. 6,232,613; 6,031,241 and 5,963,616 to Silfvast et al. by the same assignee as the subject invention, and are all incorporated by reference in the subject invention.

Various solutions have been proposed over the years. Such capillary discharge sources have included those by one of the subject inventors, and by the same assignee as that of the subject invention. For example, U.S. Pat. No. 6,232,613 to Silfvast et al. describes the use of debris blockers and collectors for capillary discharge sources. In the '613 patent, electrodes can be positioned to prevent and block debris generated from the capillary from being expelled into the optic components used with the discharge source. Other electrodes and components were used to collect the debris.

Although the '613 patent reduces the effects of the debris, it still does not reduce nor eliminate the actual generation of the debris from the plasma discharge sources.

Other known types of plasma discharge sources have included the use of wires. It has been shown by a group at Cornell University (David Hammer, Dept of Physics) that a discharge plasma created by evaporating a 'cross' of two metal wires between two electrodes, produces a bright, pinched plasma at the point at which the two wires cross. (one ref is "X-ray Source Characterization of Aluminum X-pinch Plasmas Driven by the 0.5 TW LION Accelerator," N. Qi, D. A. Hammer, D. H. Kalantar, G. D. Rondeau, J. B. Workman, M. C. Richardson and Hong Chen, *Proc. 2nd Int. Conf. on High Density Pinches*, Los Angeles, pp. 71, (A.I.P.) April 1989, which is nonessential subject matter incorporated by reference), but there are many references to this work. However, exploding wires create other problems. For example, the wires are not reusable and can also generate debris.

SUMMARY OF THE INVENTION

A primary objective of the invention is to provide a plasma discharge source(s) for generating emissions in the VUV, EUV and X-ray spectral regions that can use liquid jet initiated plasma discharges.

A second objective of the invention is to provide a plasma discharge source(s) for generating emissions in the VUV, EUV and X-ray spectral region that can use liquid droplet initiated plasma discharges.

A third objective of the invention is to provide a plasma discharge source(s) for generating emissions in the VUV, EUV and X-ray spectral region resulting in reduced damage on related optic components caused the emission of debris.

A fourth objective of the invention is to provide a plasma discharge source(s) for generating emissions in the VUV, EUV and X-ray spectral regions that reduces debris generation from the source(s). Because the plasma can be generated in an unconfined region, there will be no debris generated from a confining medium such as a narrow capillary.

A fifth objective of the invention is to provide a plasma discharge source(s) for generating emissions in the VUV, EUV and X-ray spectral regions that has increased longevity over existing gas formed plasma discharge sources.

A sixth objective of the invention is to provide a plasma discharge source(s) for generating emissions in the VUV, EUV and X-ray spectral region, where the plasma can be initiated in a well-defined region without the assistance of a capillary to confine it.

A seventh objective of the invention is to provide a plasma discharge source(s) for generating emissions in the VUV, EUV and X-ray spectral region where the plasma can be located in a very low-pressure region so as to avoid absorption of the useful radiation by a surrounding gaseous medium.

An eighth objective of the invention is to provide a plasma discharge source(s) for generating emissions in the VUV, EUV and X-ray spectral region where the amount of gas within the plasma can be controlled by the diameter of a jet stream or liquid droplets.

A ninth objective of the invention is to provide a plasma discharge source(s) for generating emissions in the VUV, EUV and X-ray spectral region where the length of the plasma can be easily adjusted by adjusting the space between electrodes and having a jet stream or liquid droplet active length be determined by that spacing. The plasma material, the desired radiating species, can be selected by choosing the appropriate liquid jet material or droplet material.

Preferred embodiments of the invention include systems of using a liquid jet stream within a vacuum region to initiate a plasma discharge for generating emissions in the VUV, EUV or X-ray spectral regions. The liquid jet stream can be composed of the constituent radiating material, as well as other useful components, and would be directed between two electrodes. The jet stream can serve as the initial conducting path between the electrodes when a high voltage is applied between the electrodes. The initial current between the electrodes can occur within the liquid jet stream, thereby heating the material within the jet, causing it to vaporize and convert to an expanding gaseous plasma discharge. The discharge current can be operated for a duration of up to approximately a few microseconds. The diameter of the jet stream can be determined by the quantity of vaporized ions desired to be within the plasma discharge as it expands. The velocity of the jet stream can be of the order of approximately 50 m/sec, which can allow a pulse repetition frequency of the order of approximately 5 kHz to be used and still allow the jet stream to reform between pulses. The expanding ionized gas can be pumped out of the system between pulses, or collected on the surrounding collecting plates in situations in which the jet stream material consists of a vapor at room temperature instead of a gas. A pre-pulse can be advantageous in order to vaporize the liquid before the main current pulse is initiated.

Additional preferred embodiments include systems that can use liquid droplets with the space to initiate plasma discharges for generating emissions also in the VUV, EUV, and X-ray spectral regions, and have similar results to using the liquid jet streams described above. Other embodiments can include two or more conductive liquid paths that are parallel to one another, and that can form substantially cylindrical imploding sheath shaped plasmas. Another embodiment can form a substantially conical shaped imploding plasma. Another embodiment can form crossed over plasmas within a space with a single bright light emission discharge.

Further objects and advantages of this invention will be apparent from the following detailed description of a presently preferred embodiment which is illustrated schematically in the accompanying drawings.

DESCRIPTION OF THE PREFERRED EMBODIMENTS

Before explaining the disclosed embodiments of the present invention in detail it is to be understood that the invention is not limited in its application to the details of the particular arrangement shown since the invention is capable of other embodiments. Also, the terminology used herein is for the purpose of description and not of limitation.

First Preferred Embodiment

Figure 1:
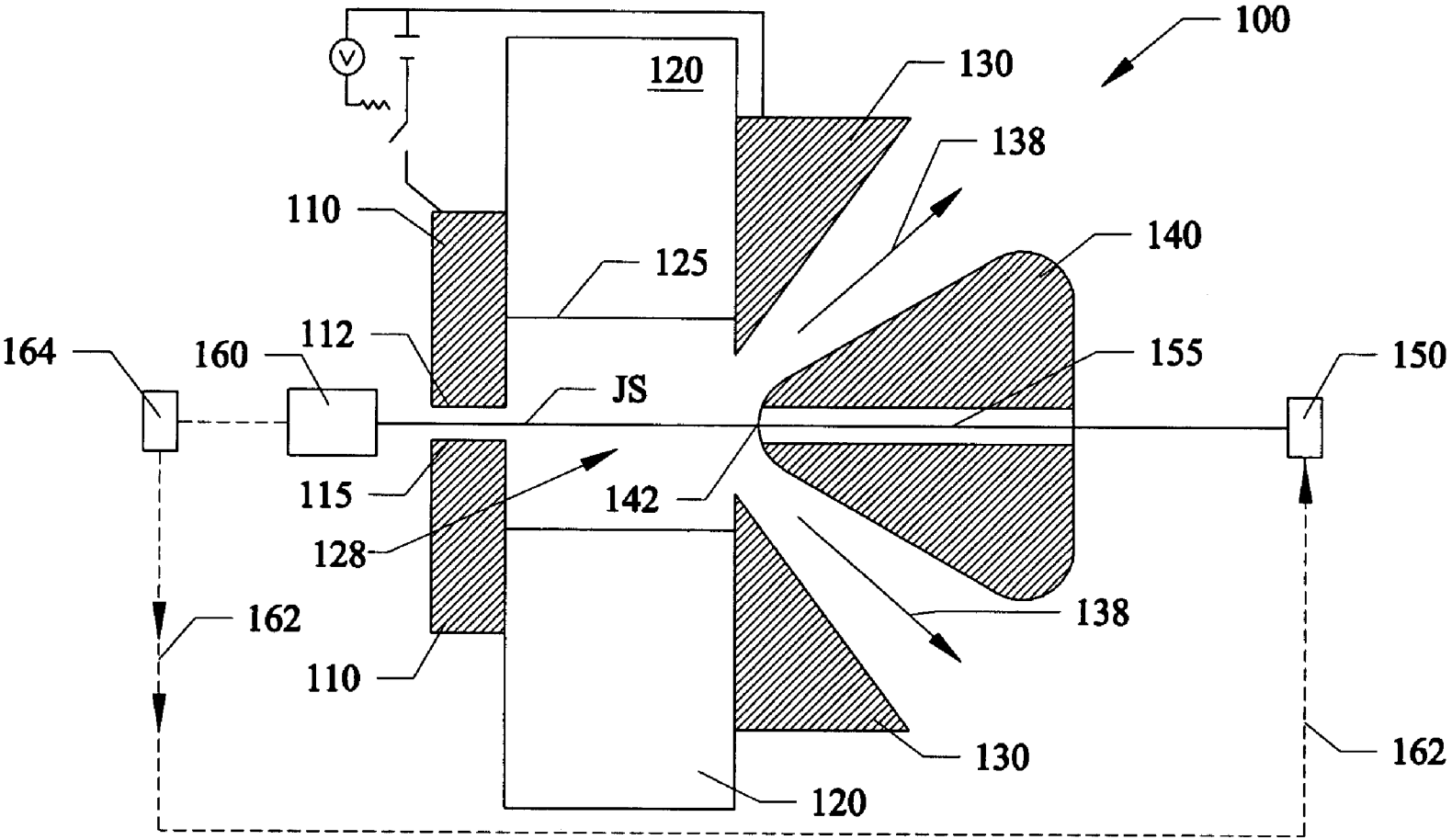
FIG. 1 shows a cross-sectional view of a first preferred embodiment of an inertially confined liquid jet discharge source.

FIG. 1 shows a cross-sectional view of a first preferred embodiment 100 of an inertially confined liquid jet discharge source. 110 refers to electrodes having a space 115 formed there between. An electrode 110, such as a metal electrode can function as an anode, and be to one side of an insulator 120, such as an electrically insulating or partially insulating insulator such as but not limited to an insulating material such as rubber, a ceramic, glass, and the like. On the opposite side of the insulator 120 can be a second electrode 130–140, such as a metal electrode that can function as a cathode. Either electrode 110, 130/140 can also function as an emitter or collector of the liquid jet. Electrode portion 140 can function like a debris blocker similar to those described in U.S. Pat. No. 6,232,613 to the same assignee as that of the subject invention, which is incorporated by reference. Liquid jet stream generating device 150 can be a pressurized metal or insulative liquid reservoir for supplying liquid to a liquid jet injector 155, such as a micron-sized metal or insulator capillary, or other liquid jet-producing assembly. A receptical 160 such as a metal or insulator container, that can be cryogenically cooled can be used to collect unused liquid jet material from the discharge source 100.

A conventional high voltage generating system such as that indicated in FIG. 1 can be used supply voltage to the electrodes 110, 130/140 in order to run current through the jet stream JS formed within the space 125 of the discharge source 100.

The liquid jet injector 155 can be used to generate a continuous conductive liquid jet stream which provides a current path JS within the space 125.

In operation, a plasma column 128 can be formed within space 125 within insulator 120 and electrodes 110, 130, 140 from a thin approximately 10 microns diameter jet of liquid that was generated by the liquid jet stream generating device 150 and liquid injector 155, and the receptacle 160 for collecting the unused portions of the jet stream, As an example, the electrodes 110, 130 can be separated by a distance such as but not limited to approximately 5 mm. Each electrode 110, 130 can have a hole in the center, at one end to allow the newly generated jet stream to pass through, and at the other end to intercept and collect the unused portion of the liquid material. A liquid jet can emanate from the micron sized injector 155, producing threads of liquid streams through the hole opening 142 in electrode 140, and can produce a conductive thread between electrodes 140 and 110. Unused jet material passes through opening 112 in electrode 110 and can be collected in receptical 160. Opening 112 must be large enough to allow unused material to be collected in receptical 160, through electrode 110.

When a high voltage is rapidly applied between the electrodes 110, 130, the highly conducting liquid of the jet stream will conduct the current between the electrodes 110, 130. Various levels of power can be run through the discharge source, and can include but not be limited to ranges of approximately 2 to approximately 10 kilo amps, and more.

With sufficient current, of the order of approximately 2 to approximately 10 kilo Amperes, the atoms of the liquid will rapidly vaporize and ionize, producing the desired ion stage containing the radiating transitions within that material.

After the current pulse terminates, the following portion of the jet stream will reform between the electrodes, awaiting the next current pulse. Assuming that the ions were heated to a velocity of approximately $10^4$ cm/sec, and the current pulse would last for approximately one microsecond, the plasma would expand to a size of approximately 1 to approximately 2 mm, a diameter that is suitable for a micro-lithographic imaging source.

For a continuous conductive jet stream having a diameter of approximately 10 microns, the number of atoms within the approximately 5 mm long jet would be approximately $10^{16}$ and if the plasma expands to a diameter of approximately 2 mm, the ion density at that point would be of the order of approximately $10^{18}$ $cm^3$. Smaller or larger jet stream diameters can reduce or increase the ion density when the plasma is formed to obtain the desired density.

For a jet stream traveling at a velocity of approximately 50 m/sec, in one microsecond, the stream would have traveled approximately 0.5 microns, thereby not sufficiently far to introduce new cold liquid material into the newly formed hot plasma. However, at a repetition rate of approximately 5 kHz, there would be an elapsed time of approximately 200 microseconds between pulses, during which time the liquid jet would travel a distance of approximately 1 cm, thereby refilling the area between the electrodes with a new liquid jet stream awaiting the next high voltage initiating pulse. The jet stream velocity, and therefore the maximum possible source repetition rate, can be adjusted by increasing the jet reservoir pressure.

Radiating species comprising the jet stream can include any material that can be liquified and operated in a jet, including, but not restricted to, the following species generated in their liquid form: Noble gases such as He(helium), Ne(neon), Ar(Argon), Kr(krypton), Xe(zenon), molecules such as water, ethanol, $SF_6$(sulfur hexafluoride) and vapors such as Sn(tin), Ga(gallium), Hg(mercury), and other materials, elements, molecules, or combinations thereof, that can be normally within a liquid state.

In the discharge source 100, the liquid jet injector 155 can be switched on and provides a thread of conductive material, which can act like a lightning conductor when a high voltage is applied between the electrodes 110 and 140. The resulting high current flowing through the liquid jet vaporizes the jet material into a hot dense plasma 128 that will emit strong EUV, VUV and X-ray emissions. The spectrum of the emission from the plasma is characteristic of the liquid jet materials used to produce the plasma 128 and will include a continuous spectrum with a spectral shape characteristic of a thermal (Planckian) source, and will also inlcude characteristic spectral line emissions from excited ion transitions. Once a single discharge is terminated (ends), the conductive liquid jet is constantly renewed by the injector 155 and reservoir 150 regenerates the liquid jet to be ready for a fresh discharge.

Referring to FIG. 1, the hot dense plasma 128 produced by the discharge consists of high velocity ions of several ionized species of the material of the conductive liquid jet, together with the electrons that have been stripped off the atoms of the jet material. The strong, transient electrical current in this plasma can produce a strong magnetic pinch, by the Faraday Effect, that constrains the plasma to a narrow cylindrical region, and keeps the particle density high.

Short wavelength emission can then be produced by the two effects mentioned above, namely [1] thermal emission emanating from the continuous collision of ions and electrons in the plasma (the spectrum of this emission depends upon the temperature (velocity) of the colliding ions and electrons, and their masses), and [2] specific spectral line emission resulting from the de-excitation of excited ions. The wavelengths of this line emission are characteristic of the energy separation of the quantized energy levels of the transition. In these transitions, and electron 'jumps' from a higher (excited) orbit, to a lower, (less excited) orbit with the concurrent emission of radiant energy, satisfying overall energy conservation in the transition. The spectra in the emissions can be characteristic of the plasma operating conditions, such as but not limited to temperature, density, liquid material used, as previously described.

A feedback recycler 162 can also be included with the discharge source 100, where a fluid pump 164 can be used to recycle unused conductive liquid from the receptacle 160 to resupply the liquid reservoir source 150.

Second Preferred Embodiment

Figure 2:
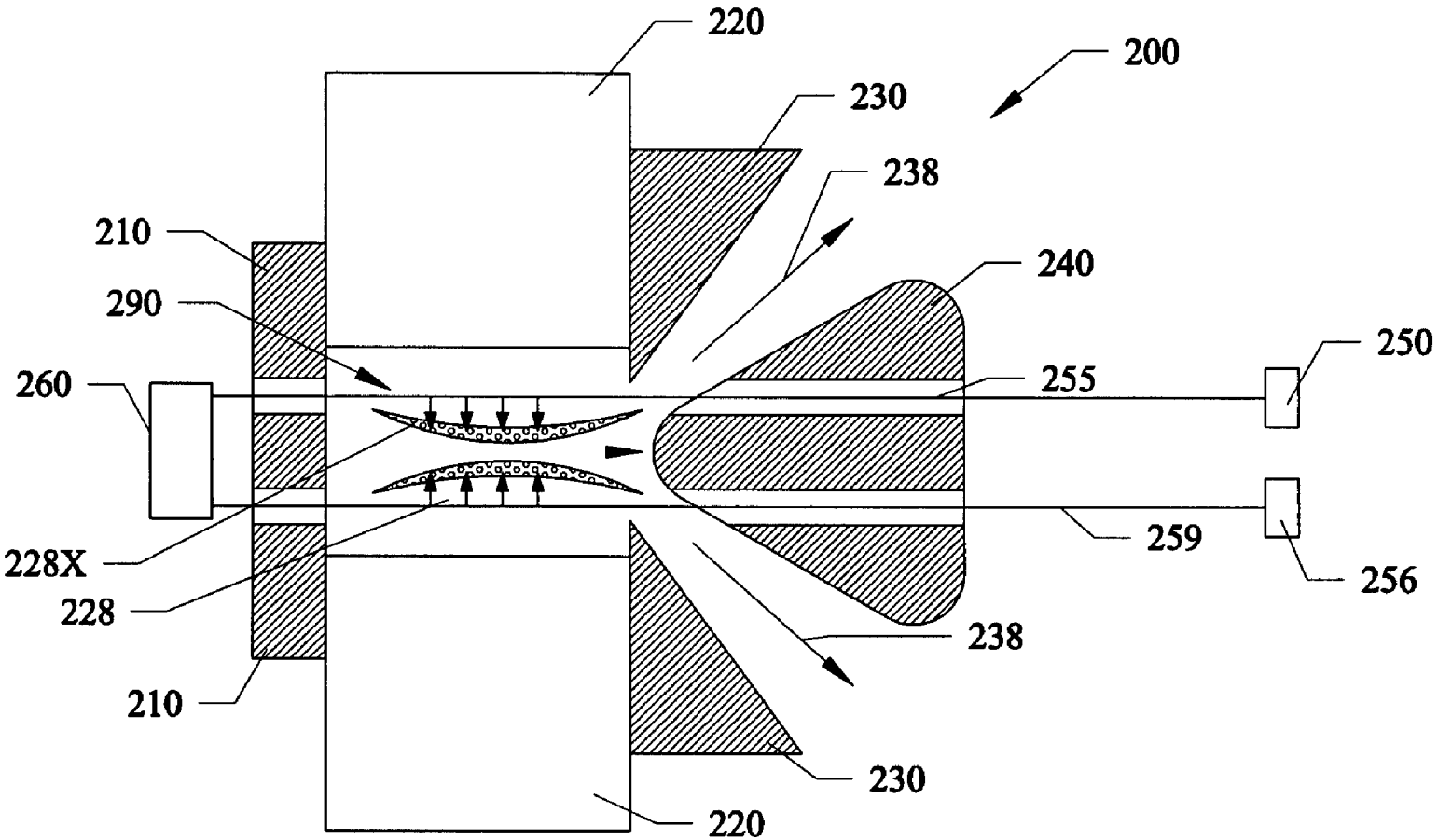
FIG. 2 shows a cross-sectional view of a second preferred embodiment of a liquid jet pinch plasma discharge source with a cylindrical variant.

FIG. 2 shows a cross-sectional view of a second preferred embodiment 200 of a liquid jet pinch plasma discharge source with a cylindrical variant 228. Electrode (Anode) 210, insulator 220, electrode (cathode) 230, 240, and receptical 260 can be identical to the similarly labeled components in the embodiment of FIG. 1. In FIG. 2, there can be two or more liquid jet stream generating devices 250, 256, and two or more liquid jet injectors 255, 259 each similar to the liquid jet generating device (reservoir) 150, and jet injector 155 shown and described in FIG. 1. Alternatively, several liquid jet injectors can be run from a common liquid jet stream generating device.

The liquid jet injectors 255, 259 can be used to generate a continuous conductive liquid jet stream which provides a current path. In essence the current will run through the jet stream.

The functional description of all components of the source 200 in FIG. 2 can be identical to that those shown in FIG. 1. The difference in this embodiment is that the single liquid jet assembly is replaced with an array of two or more liquid jets, possibly up to 10 liquid jets, or more, that can form a small cylindrical ring of parallel jet paths. The diameter of the ring can be approximately 100 microns, and comprise of approximately 2 to approximately 10 separate liquid jets (each having a diameter of approximately 10 microns, or less). The function of this ring would be different from the first embodiment (FIG. 1) in the following respect. The discharge between the two electrodes (210 and 230/240) would ionize all these small jets, producing a cylindrical sheath of plasma 228X. The transient current flowing through this sheath of plasma 228 would cause the sheath plasma 228 to rapidly compress towards its cylinder axis 228X. The stagnation of this compressing plasma imploding on itself at the axis, can further heat the plasma 228 to higher temperatures, and create higher plasma densities, which can lead to a more efficient radiation production. This embodiment also has another advantage. Since the emitting plasma is now located in a region 228X off-axis from each of the individual axes of the jets 255, 259, the latter are more immune and less susceptible to plasma damage than in the first embodiment 100 shown in FIG. 1.

Similar to the previous embodiment the resulting high current flowing through the liquid jets from the electrodes 210, 230/240 vaporizes the jet material into a hot dense plasma 228 that that can emit strong EUV, VUV and X-ray emissions. Similar to the first embodiment, this embodiment can also incorporate a recycling loop for unused conductive liquid from the receptical 260.

Third Preferred Embodiment

Figure 3:
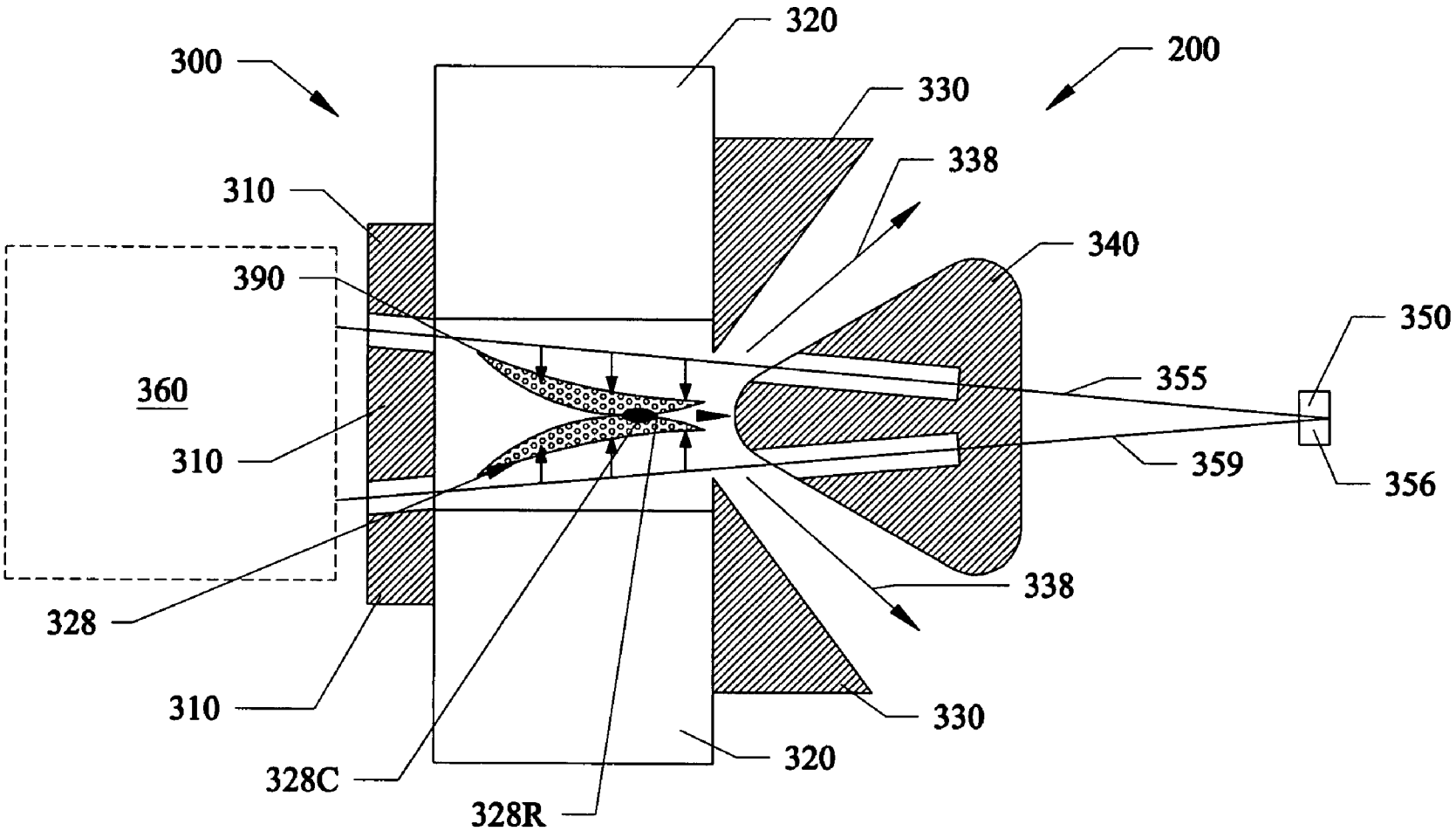
FIG. 3 shows a cross-sectional view of third preferred embodiment of a jet pinch plasma discharge with a conical variant.

FIG. 3 shows a cross-sectional view of third preferred embodiment 300 of a jet pinch plasma discharge with a conical variant. Electrode (Anode) 310, insulator 320, electrode (cathode) 330/340, liquid jet steam generating devices 350, 356, liquid jet injectors 355, 359, and receptical 360 are each similar to the similarly labeled components in the preceeding embodiments.

Similar to the previous embodiments, the injectors 355, 359 can be used to generate a continuous conductive liquid jet stream which provides a current path.

The functional description of all the components in FIG. 3 are identical to those shown in FIG. 1. The function of the cylindrical sets of jets is the same as in the second embodiment (FIG. 2), except that the cylindrical plasma sheath is now a (slightly) conical plasma sheath. This slightly conical plasma sheath can be produced by a conical array of jet assemblies and receptical(s). The compressing sheath plasma can converge on itself in the same manner as the second embodiment, except that, due to its conical configuration, the stagnation of the cylindrically imploding sheath plasma will occur first at a right side 328R, in FIG. 3, nearest electrode 340. Since the current density at this point will be the highest in the plasma 328, this will be the point of brightest emission, localizing the emission to a smaller spot 328C on the axis, close to electrode 340, and preferable for the angular emission directions indicated in the figure. The converging plasma 328 will stagnate first at a hot spot 328C. The preferential heating at this point will create localized heating and therefore a localized bright spot. Another advantage of this embodiment 300 is that the plasma particle debris emission 338 that follows the production of the plasma 328, on the right side is directed away from the discharge area, away from the jet assemblies 355, 359 and the electrodes 310, 330/340 (into the benign regions of the vacuum vessel in which the source is housed), thereby improving lifetime and stability of the source.

Similar to the previous embodiments the resulting high current flowing through the liquid jets from the electrodes 310, 330/340 vaporizes the jet material into a hot dense plasma 328 that that can emit strong EUV, VUV and X-ray emissions. Similar to the previous embodiments, this embodiment can also incorporate a recycling loop for unused conductive liquid from the receptical(s) 360.

Fourth Embodiment

Figure 4:
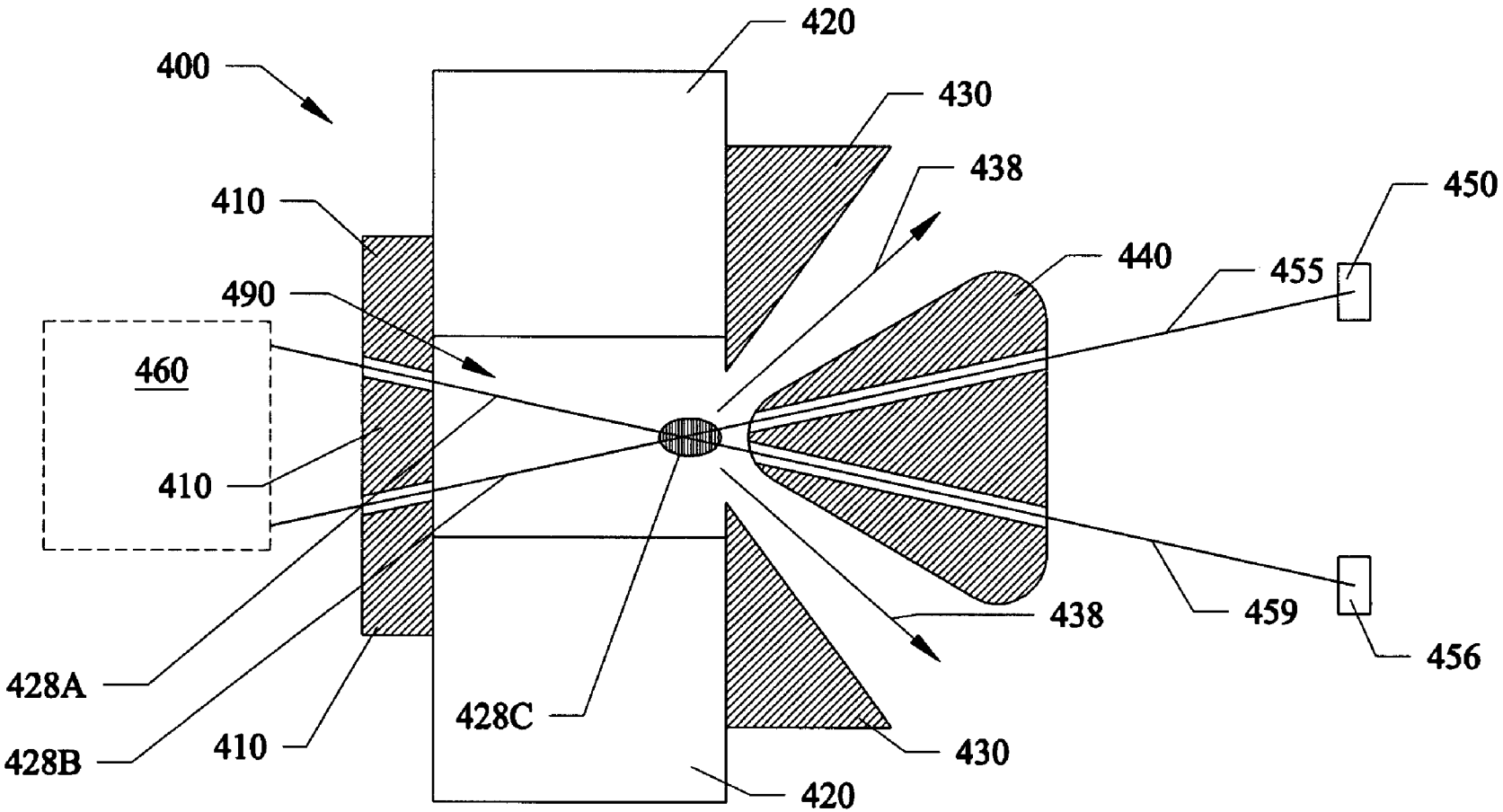
FIG. 4 shows a cross-sectional view of fourth preferred embodiment of a crossed jet stream plasma discharge source with a crossed liquid wire variant.

FIG. 4 shows a cross-sectional view of fourth preferred embodiment 400 of a crossed jet stream plasma discharge source with a crossed source variant. Electrode (Anode) 410, insulator 420, electrode (cathode) 430/440, liquid jet steam generating devices 450, 456, liquid jet injectors 455, 459, and receptical 460 can be identical to those components of the previous embodiments.

Similar to the previous embodiments, the jet injectors 455, 459 can be used to generate a continuous conductive liquid jet stream which provides a current path.

In this fourth embodiment 400 two liquid jet 'crosses' 455, 459 are used. The emitted conductive liquid jets do not quite touch one another, but they can be sufficiently close that when the electrical discharge between electrodes 410 and 430/440 vaporizes the liquid jets, there would be conductive path between the two and a 'cross' would be formed by the two plasmas 428A, 428B. The subsequent flow of current through the cross would produce the formation of a small, localized bright emission region 428C, which can have a similar source effect to that of the crossed wires described in the prior art but without the problems of the prior art. The linear inertially expanding plasmas 428A, 428B can be created by jets 455, 459. At this cross-over, located at a source point 428C, a localized pinch occurs, which can produce a bright spherical light source emission.

Similar to the previous embodiments the resulting high current flowing through the liquid jets from the electrodes 410, 430/440 vaporizes the jet material into a hot dense plasmas 428A, 428B which form a bright spherical bright light source emission 428C that that can emit strong EUV, VUV and X-ray emissions. Similar to the previous embodiments, this embodiment can also incorporate a recycling loop for unused conductive liquid from the receptical(s) 460.

Fifth Embodiment

Figure 5:
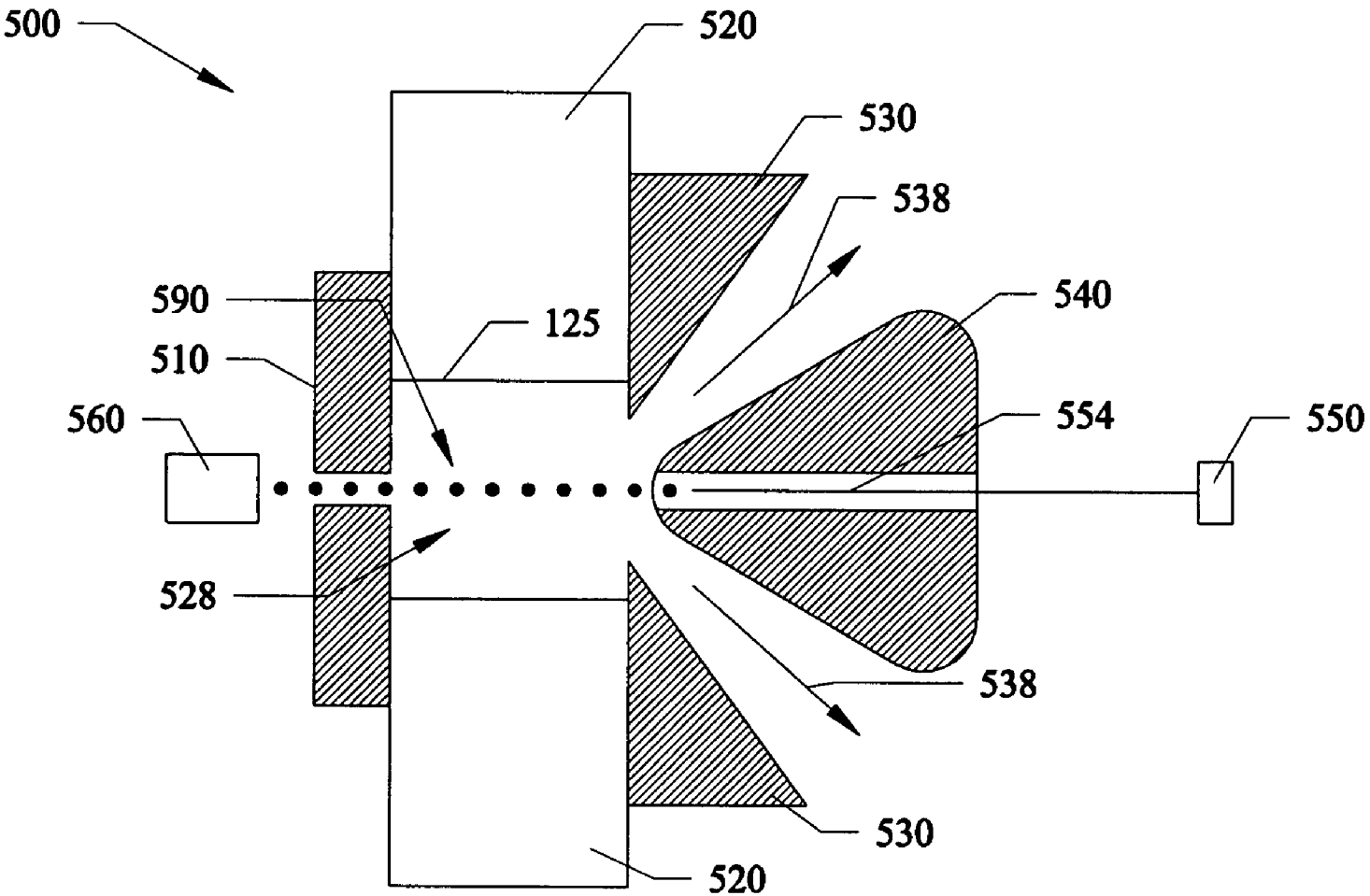
FIG. 5 shows a cross-sectional view of a fifth preferred embodiment of an inertially confined droplet discharge source.

FIG. 5 shows a cross-sectional view of a fifth preferred embodiment 500 of an inertially confined droplet discharge source. Electrode (Anode) 510, insulator 520, electrode (cathode) 530/540, and receptical 560 can be similar to those of the preceeding embodiments.

The fifth embodiment is similar to and function similar that of the first embodiment with the exception that the continuous liquid jet stream(s), threads of liquid 'wires', is replaced with continuous stream(s) of high velocity liquid droplets. These droplets can be formed hydro-dynamically, just like droplets from a water faucet, in a continuous and controlled way by mechanically vibrating the end of the capillary or jet-forming assembly at a characteristic frequency.

The fifth embodiment 500 can include droplet generating device 550, and droplet injector 555 which can include a pressurized tank/reservoir and a nozzle jet high repetition rate liquid-droplet injectors such as those described and shown in U.S. Pat. Nos. 5,126,755 and 5,142,297 and 6,357,651 by one of the inventors of the subject invention, which are all incorporated by reference. The droplets can be formed from ink jet systems, or other droplet forming systems and can include various individual droplet sizes between approximately 50 to approximately 200 ngm in mass, and have diameters between approximately 10 microns to approximately 80 microns. Droplet frequency ranges can be between approximately 20 kHz to approximately 100 kHz.

An advantage of using droplets, is that the overall target material mass (droplet vs jet) may be lower, and this can also lead to lower debris production.

Similar to the previous embodiments the resulting high current flowing through the liquid droplets from the electrodes 510, 530/540 vaporizes the droplet material into a hot dense plasma 528 that that can emit strong EUV, VUV and X-ray emissions. Similar to the previous embodiments, this embodiment can also incorporate a recycling loop for unused conductive liquid from the receptical(s) 560.

Sixth Embodiment

Figure 6:
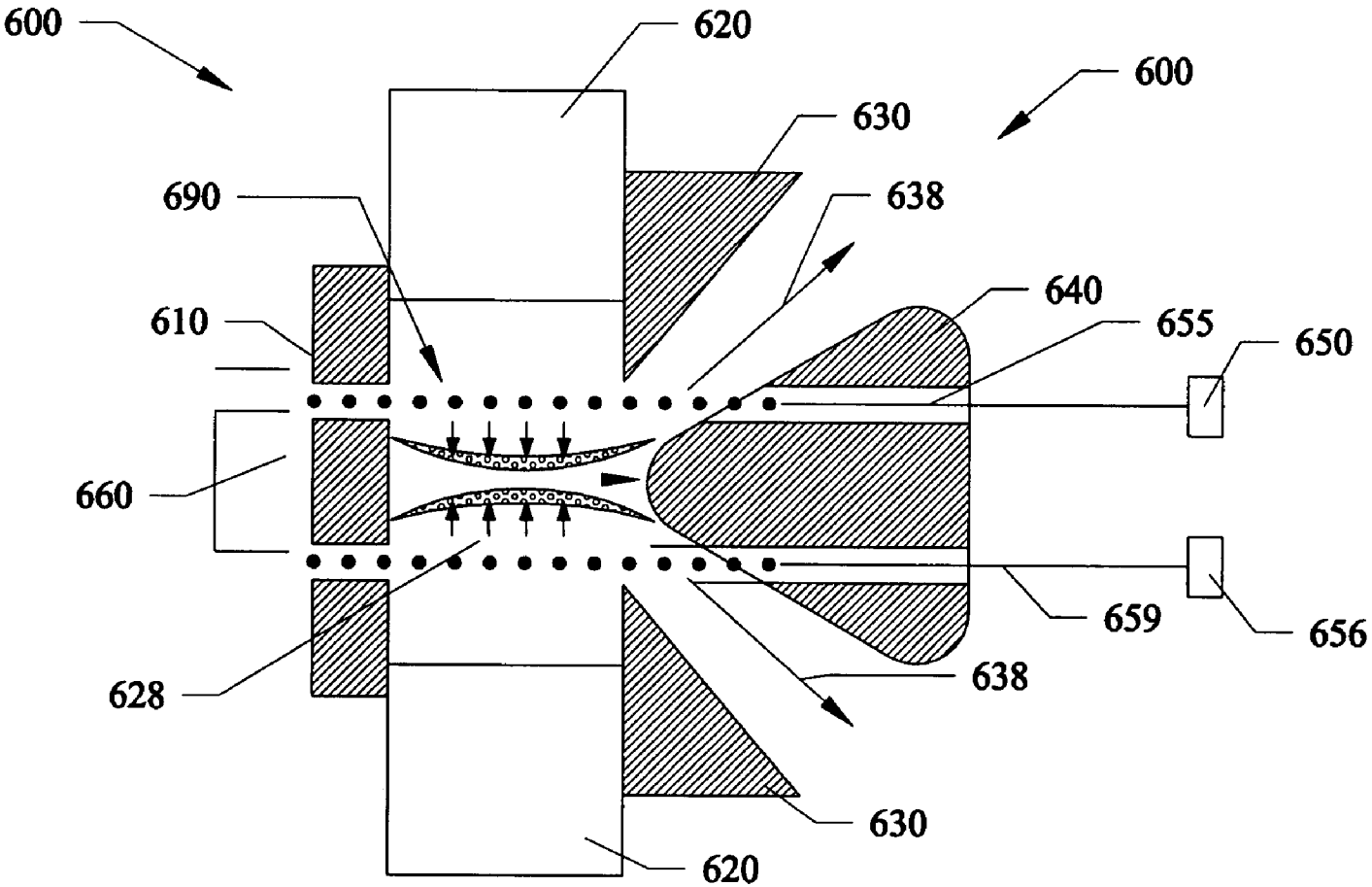
FIG. 6 shows a cross-sectional view of a sixth preferred embodiment of a droplet pinch plasma discharge source.

FIG. 6 shows a cross-sectional view of a sixth preferred embodiment 600 of a droplet pinch plasma discharge source. Electrode (Anode) 610, insulator 620, electrode (cathode) 630/640, droplet generating device 650, 656, droplet injectors 655, 659, and receptical 660 similar to that of the previous embodiment.

The sixth embodiment 600 can function similar to with the exception that the continuous liquid jet stream(s), threads of liquid 'wires', is replaced with continuous stream(s) of high velocity liquid droplets. These droplets can be formed hydro-dynamically, just like droplets from a water faucet, in a continuous and controlled way by mechanically vibrating the end of the capillary or jet-forming assembly at a characteristic frequency.

The sixth embodiment 600 can include approximately 2 to approximately 10 droplet generating devices 650, 656, and droplet injectors 655, 659 which can each include a pressurized tank/reservoir and a nozzle jet high repetition rate liquid-droplet injectors such as those described and shown in U.S. Pat. Nos. 5,126,755 and 5,142,297 and 6,357,651 by one of the inventors of the subject invention, which are all incorporated by reference. The droplets can be formed from ink jet systems and can include various individual droplet sizes between approximately 50 to approximately 200 ngm in mass, and have diameters between approximately 40 microns to approximately 80 microns. Droplet frequency ranges can be between approximately 20 kHz to approximately 100 kHz.

In the sixth embodiment 600, there can be two to approximately 10 or more parallel arranged injectors that can be formed into a substantially cylindrical array to form a substantially cylindrical sheath 628 which can function similar to that of the second embodiment 200 previously described.

An advantage of using droplets, is that the overall target material mass (droplet vs jet) will be lower, and this can also lead to lower debris production.

Similar to the previous embodiments the resulting high current flowing through the liquid droplets from the electrodes 610, 630/640 vaporizes the droplet material into a hot dense plasma 628 that can emit strong EUV, VUV and X-ray emissions. Similar to the previous embodiments, this embodiment can also incorporate a recycling loop for unused conductive liquid from the receptical(s) 660.

Seventh Embodiment

Figure 7:
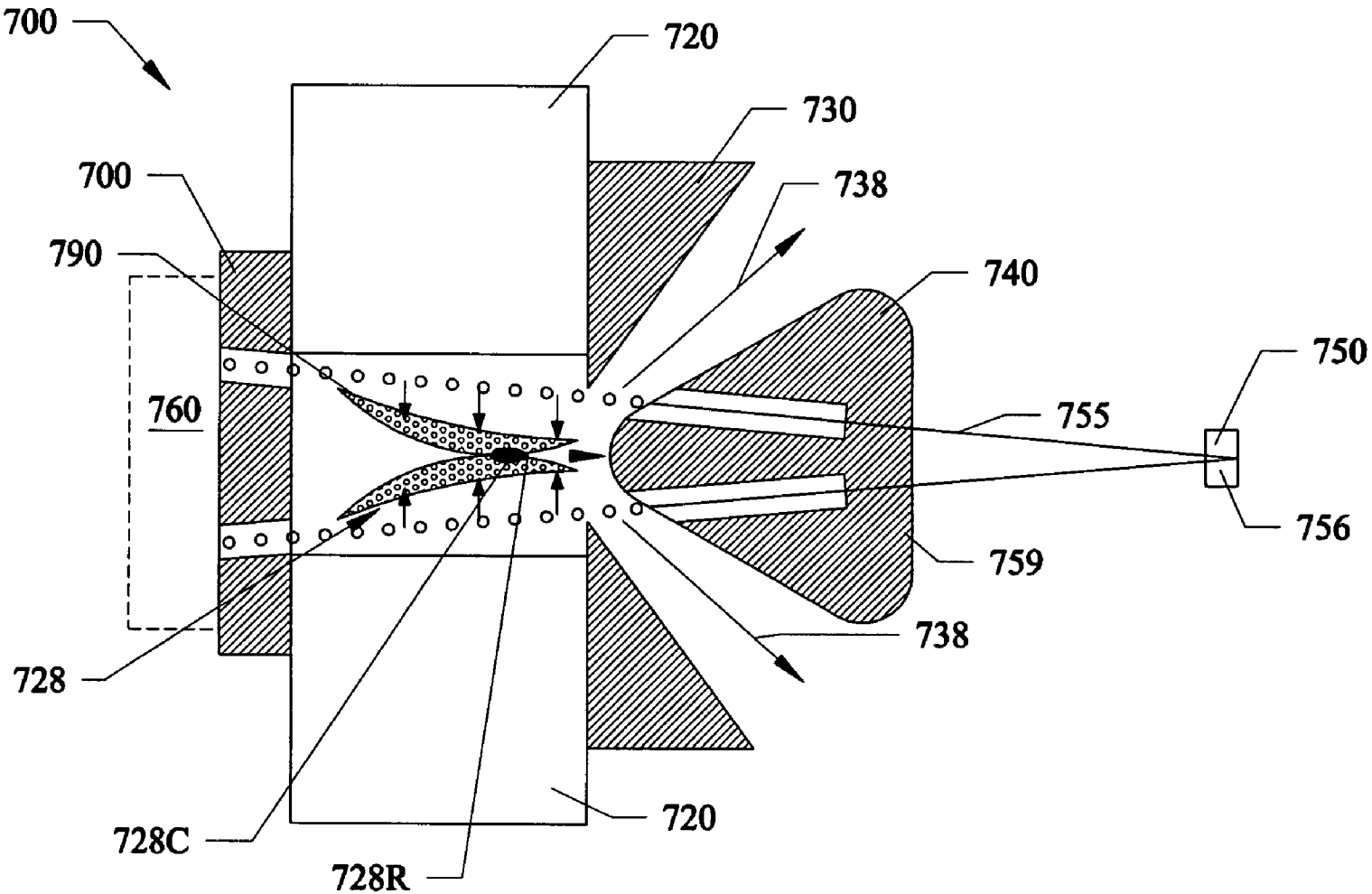
FIG. 7 shows a cross-sectional view of a seventh preferred embodiment of a droplet pinch plasma discharge source with conical variant.

FIG. 7 shows a cross-sectional view of a seventh preferred embodiment 700 of a droplet pinch plasma capillary discharge source with conical variant. Electrode (Anode) 710, insulator 720, electrode (cathode) 730/740, droplet generating devices 750, 756, droplet injectors 755, 759 and receptical 760, converging plasma 728C, right converging plasma 728R, correspond to and function similar to similar numbered labels in the third embodiment 300 previously described with the exception that the continuous liquid jet stream(s), threads of liquid 'wires', is replaced with continuous stream(s) of high velocity liquid droplets. These droplets can be formed hydrodynamically, just like droplets from a water faucet, in a continuous and controlled way by mechanically vibrating the end of the capillary or jet-forming assembly at a characteristic frequency.

The seventh embodiment 700 can include droplet generating devices 750, 756, and droplet injectors 755, 759 which can include a pressurized tank/reservoir and a nozzle jet high repetition rate liquid-droplet injectors such as those described and shown in U.S. Pat. Nos. 5,126,755 and 5,142,297 and 6,357,651 by one of the inventors of the subject invention, which are all incorporated by reference. The droplets can be formed from ink jet systems and can include various individual droplet sizes between approximately 50 to approximately 200 ngm in mass, and have diameters between approximately 40 microns to approximately 80 microns. Droplet frequency ranges can be between approximately 20 kHz to approximately 100 kHz.

In the seventh embodiment 700, there can be two to approximately 10 or more parallel arranged injectors that can be formed into a substantially conical cylindrical array to form a substantially conical cylindrical sheath 728 which can function similar to that of the third embodiment 300 previously described.

An advantage of using droplets, is that the overall target material mass (droplet vs jet) will be lower, and this can also lead to lower debris production.

Similar to the previous embodiments the resulting high current flowing through the liquid droplets from the electrodes 710, 730/740 vaporizes the droplet material into a hot dense plasma 728 that that can emit strong EUV, VUV and X-ray emissions. Similar to the previous embodiments, this embodiment can also incorporate a recycling loop for unused conductive liquid from the receptical(s) 760.

Eigth Embodiment

Figure 8:
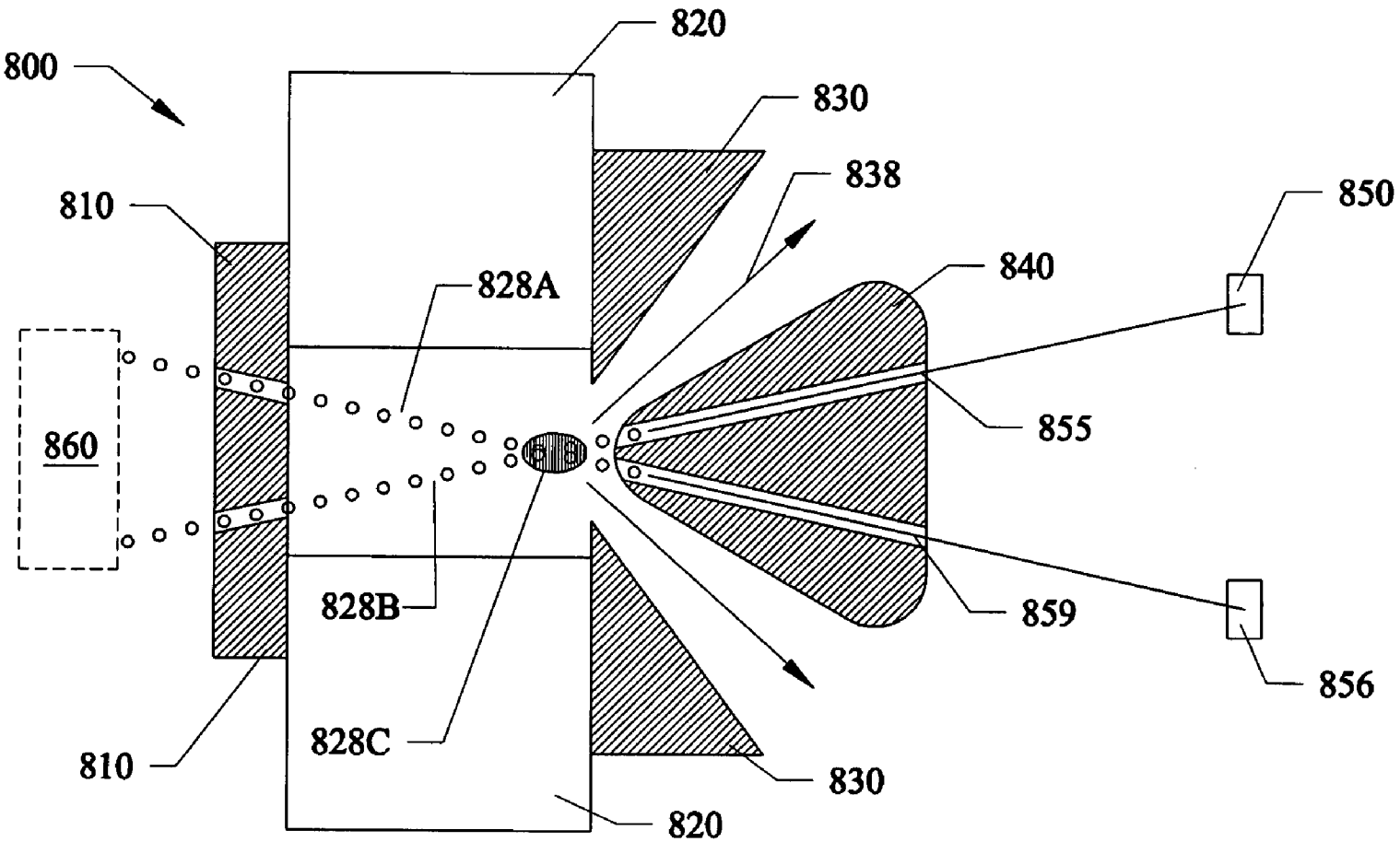
FIG. 8 shows a cross-sectional view of an eigth preferred embodiment of a crossed droplet stream plasma discharge source with crossed liquid-wire source variant.

FIG. 8 shows a cross-sectional view of an eigth preferred embodiment 800 of a crossed droplet stream plasma discharge source with crossed-wire x-ray source variant. Electrode (Anode) 10, insulator 820, electrode (cathode) 830/840, droplet generating devices 850, 856, liquid jet injectors 855, 859, receptical 860, linear crossing plasmas 828A, 828B, and source point 828C correspond and function similar to like labels in the fourth embodiment 400 previously described with the exception that the continuous liquid jet stream(s), threads of liquid 'wires', is replaced with continuous stream(s) of high velocity liquid droplets. These droplets can be formed hydro-dynamically, just like droplets from a water faucet, in a continuous and controlled way by mechanically vibrating the end of the capillary or jet-forming assembly at a characteristic frequency.

The eighth embodiment 800 can include droplet generating devices 850, 856, and droplet injectors 855, 859 which can include a pressurized tank/reservoir and a nozzle jet high repetition rate liquid-droplet injectors such as those described and shown in U.S. Pat. Nos. 5,126,755 and 5,142,297 and 6,357,651 by one of the inventors of the subject invention, which are all incorporated by reference. The droplets can be formed from ink jet systems and can include various individual droplet sizes between approximately 50 to approximately 200 ngm in mass, and have diameters between approximately 40 microns to approximately 80 microns. Droplet frequency ranges can be between approximately 20 kHz to approximately 100 kHz.

In the eigth embodiment 800, there can be at least two droplet injectors 855, 859 which can function similar to that of the fourth embodiment 400 previously described, where a cross-over of two linear expanding plasmas 828A, 828B cause a source point 828C, localized pinch to occur producing a bright spherical light emission source.

An advantage of using droplets, is that the overall target material mass (droplet vs jet) will be lower, and this can also lead to lower debris production.

Similar to the previous embodiments the resulting high current flowing through the liquid droplets from the electrodes 810, 830/840 vaporizes the droplet material into a hot dense plasma 828 that that can emit strong EUV, VUV and X-ray emissions. Similar to the previous embodiments, this embodiment can also incorporate a recycling loop for unused conductive liquid from the receptical(s) 860.

While the embodiments describe using an insulator between the electrodes, the invention can be used without an insulator with other techniques of allowing a current to be run through either a continuous conductive liquid stream or a current run through a stream of injected conductive droplets.

Although the sources of the droplets and liquid streams are shown being generated from the right electrodes, the invention can allow for the droplets and liquid streams to be generated from within the other electrodes shown in the figures.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. A method of generating a plasma discharge from at least two conductive liquid jets, comprising the steps of:

forming a first narrow conductive liquid jet;

injecting the first narrow conductive liquid jet into a space formed between electrodes;

forming a second narrow conductive liquid jet;

injecting the second narrow conductive liquid jet into the space formed between the electrodes;

operating a short duration current pulse with the first and the second conductive liquid jets, thereby heating and vaporizing the liquid material to form a hot radiating highly ionized plasma; and generating a radiative emission from the plasma.

2. The method of claim 1, wherein the first and the second narrow conductive liquid jets are parallel to one another, and the step of operating includes the step of:

forming a compressed plasma from the conductive liquid jets.

3. The method of claim 1, further comprising the step of:

forming a substantially cylindrical sheath plasma from the first and the second conductive liquid jets.

4. The method of claim 3, wherein the step of forming the cylindrical sheath plasma includes the step of:

arranging a cylindrical array of between approximately three to approximately 10 separated narrow conductive liquid jets;

injecting each of the between three to the approximately 10 separate narrow conductive liquid jets into the space.

5. The method of claim 1, wherein the steps of forming the first and the second narrow conductive jets includes the step of:

forming continuous conductive liquid streams.

6. The method of claim 1, wherein the steps of forming the first and the second narrow conductive jets includes the step of:

forming streams of conductive droplets.

7. The method of claim 1, further comprising the step of:

forming a substantially conical cylindrical sheath plasma from the first and the second conductive liquid jets.

8. The method of claim 7, wherein the step of forming the substantially conical cylindrical sheath plasma includes the step of:

arranging a conical cylindrical array of between approximately three to approximately 10 separated narrow conductive liquid jets;

injecting each of the between three to the approximately 10 separate narrow conductive liquid jets into the space.

9. The method of claim 1, further comprising the step of:

forming substantially crossed plasmas from the first and the second conductive liquid jets.

10. The method of claim 9, wherein the step of forming the substantially crossed plasmas includes the step of:

arranging the first and the second narrow conductive liquid jets in a crossed pattern; and injecting the crossed narrow conductive liquid jets into the space.

11. A light emitting plasma discharge source, comprising:

means for forming a first narrow conductive liquid jet and a second narrow conductive jet;

means for injecting the first and the second narrow conductive liquid jet into a space formed between electrodes; and means for applying voltage to the electrodes to form plasma within the space and for generating a spectral region emission from the plasma.

12. The source of claim 11, wherein the first and the second narrow conductive liquid jets include sources that are parallel to one another, and a compressed plasma is formed within the space.

13. The source of claim 11, wherein the plasma includes:

a substantially cylindrical sheath plasma formed from the first and the second conductive liquid jets.

14. The source of claim 13, further comprising:

a cylindrical array of between approximately three to approximately 10 separated narrow conductive liquid jets.

15. The source of claim 11, wherein the first and the second narrow conductive liquid jets include: continuous conductive liquid streams.

16. The source of claim 11, wherein the first and the second narrow conductive liquid jets include: streams of conductive droplets.

17. The source of claim 11, wherein the plasma includes:

a substantially conical cylindrical sheath plasma formed from the first and the second conductive liquid jets.

18. The source of claim 17, further comprising:

a conical cylindrical array of between approximately three to approximately 10 separated narrow conductive liquid jets.

19. The source of claim 11, wherein the plasma includes substantially crossed plasmas from the first and the second conductive liquid jets.

20. The source of claim 19, further comprising:

a crossed pattern arrangement of the first and the second narrow conductive liquid jets.

* * * * *